US005539708A

United States Patent [19]

Guignard

[11] Patent Number: 5,539,708

[45] Date of Patent: Jul. 23, 1996

[54] SPRING-BARREL SUPPLYING CONSTANT TORQUE

[75] Inventor: Henri-Michel Guignard, Cossonay, Switzerland

[73] Assignee: Frederic Piguet S.A., Le Brassus, Switzerland

[21] Appl. No.: 312,913

[22] Filed: Sep. 29, 1994

[30] Foreign Application Priority Data

Oct. 13, 1993 [CH] Switzerland ..... 3086/93

[51] Int. Cl.[6] ..... G04B 1/10

[52] U.S. Cl. ..... 368/140; 185/37

[58] Field of Search ..... 368/140–150

[56] References Cited

U.S. PATENT DOCUMENTS

| | | | |
|---|---|---|---|
| 947,147 | 1/1910 | Von Bolton | 368/140 |
| 1,922,921 | 8/1933 | Anderson | 368/140 |

FOREIGN PATENT DOCUMENTS

| | | | |
|---|---|---|---|
| 1583064 | 10/1969 | France . | |
| 2070714 | 9/1971 | France . | |
| 2056524 | 5/1971 | Germany | 368/140 |
| 375275 | 3/1964 | Switzerland . | |
| 376432 | 5/1964 | Switzerland . | |
| 1863 | 7/1863 | United Kingdom | 368/140 |

*Primary Examiner*—Bernard Roskoski
*Attorney, Agent, or Firm*—Sughrue, Mion, Zinn, Macpeak & Seas

[57] ABSTRACT

The mainspring (3) is coiled inside a barrel at an angle $\alpha=n2\pi$ radians. The spring has a rectangular section of a constant width. At least one first portion of the spring extending from the wall (2) of the barrel towards the core (5) has an increasing thickness e selected so that the coiling angle $\alpha$ times the cubed value of the thickness e has a constant value, namely $\alpha.e^3$=constant. One thus obtains, at least in the effective part, namely conventionally the first twenty four hours of operation, a constant force supplied by the barrel and consequently a constant amplitude of the balance.

3 Claims, 2 Drawing Sheets

SPRING-BARREL SUPPLYING CONSTANT TORQUE

BACKGROUND OF THE INVENTION

The present invention concerns a mainspring for a timepiece coiled inside a barrel at an angle $\alpha$ of $n2\pi$ radians, said mainspring having spiral form and a rectangular section of consistant width, the first end of the spring being hooked to a core integral with the barrel-arbor, at least a first portion of the spring extending from the wall of the barrel towards the core, exhibiting an increasing thickness e.

Swiss patent CH-A-375275 discloses a timepiece mainspring whose force gradually reduces going from the internal end to the external end for the purpose of obtaining a more regular barrel motor force and, consequently, a quasi constant amplitude of the balance.

The document cited above states that springs whose section gradually diminishes from the internal end to the external end are known. This section variation may be obtained by gradually changing, from one end to the other, notably the thickness of the spring.

Patent FR-A-1583064 discloses a rolling-mill enabling such a spring to be fabricated. It comprises two rolling cylinders able to move apart from each other under the action of an eccentric.

The first document cited above discloses a gradual reduction in thickness as a function of the coiling angle of the spring, but does not state the law according to which this reduction takes place. If it concerns a linear variation, it will be seen later that this law is not capable of providing a constant torque.

SUMMARY OF THE INVENTION

In order to overcome this disadvantage, the mainspring of the present invention has a thickness e selected in such a way that coiling angle $\alpha$ of its first portion times the cubed value of its thickness at said angle $\alpha$, has a constant value, namely, $\alpha \cdot e^3$=constant.

BRIEF DESCRIPTION OF THE DRAWING

The invention will be understood upon reading the following description which is illustrated by way of example by the drawing in which.

DESCRIPTION OF A PREFERRED EMBODIMENT

According to the "Théorie générale de l'horlogerie" by Leopold Defossez, Volume I, page 116, La Chaux-de-Fonds 1950, the elastic moment M of a rectangular section coiled-spring, of thickness e and width h, is:

$$M = \frac{E\,e^3\,h}{12\,L}\,\alpha \tag{1}$$

where $\alpha$ is the winding angle of the spring which will be classed here as its coiling angle, E is Young's modulus, and L is the length of the spring. This equation can also be written as follows:

$$\alpha \cdot e^3 = \frac{M \cdot 12L}{E \cdot h} \tag{2}$$

As a purpose of the present invention is to obtain a constant elastic moment M from the barrel, which enables a constant amplitude of the balance to be ensured, and as length L and width h of the spring are also constant, as also is Young's modulus E, the second limb of the equation (2) has a constant value. The teaching to be drawn from this is that the first limb of the equation (1), that is to say the coiling angle $\alpha$ times the cubed value of spring thickness e at said angle must have a constant value, namely $\alpha \cdot e^3$=constant.

Figure 1:
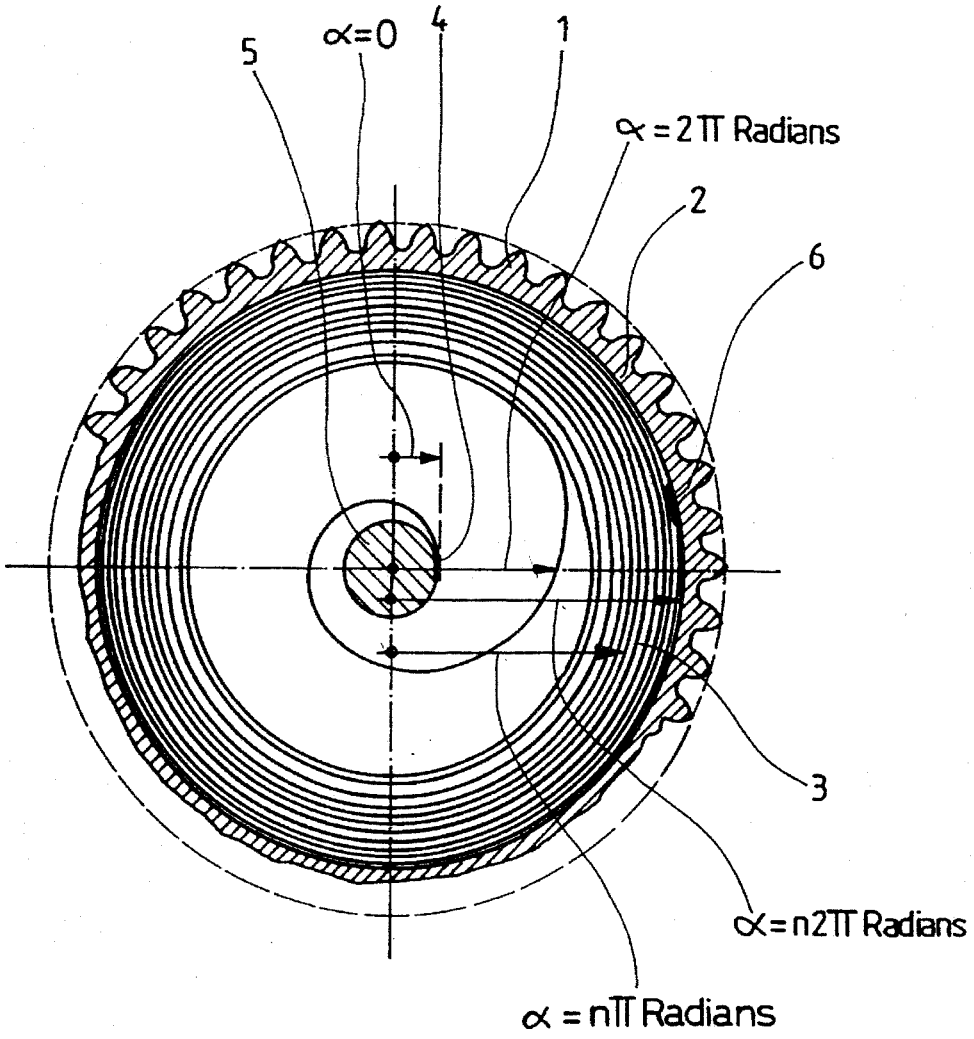
FIG. 1 is a plan view of a spring-barrel according to the invention shown in the let down state and FIG. 2 is a diagram showing spring thickness e as a function of the coiling angle of the latter.

FIG. 1 is a schematical plan view of a timepiece spring-barrel in the let down state. The barrel is a cylindrical box comprising a toothing 1 and a wall 2 inside which is coiled a spring 3 in spiral form at an angle $\alpha$ of $n2\pi$ radians, one coil being coiled on $2\pi$ radians. The spring has a rectangular section of constant width h and variable thickness e as will be seen below. The first end 4 of spring 3 is hooked to a core 5 integral with the barrel-arbor around which the spring freely rotates. The second end 6 of the spring is fixed to internal barrel wall 2. At least a first portion of the spring which extends from barrel wall 2 in the direction of core 5 has an increasing thickness e, this thickness being selected so that the coiling angle $\alpha$ of said first portion of the spring times the cubed value of said thickness at said angle $\alpha$ has a constant value, namely $\alpha \cdot e^3$=constant.

It will be noted that if the whole spring was required to fulfil the above condition, a prohibitive thickness in the core area would rapidly be reached, this thickness increasing by the power of 3. Calculations have shown that if the thickness of first end 6 of the spring is selected at 0.077 mm, the thickness of second end 4 would be 0.34 mm for the first tenth of a rotation, which is unrealistic.

It has been ascertained that it is not necessary to apply the condition $\alpha \cdot e^3$=constant to a second portion extending beyond the effective part of the spring, conventionally of the order of twenty four hours, for which its length provides the timepiece with operating power An acceptable increase in thickness is thus obtained. When the spring is wound, the coils are squeezed around the core (inverse case to that shown in FIG. 1) and it is the external coils which work. Only certain of these therefore need to fulfil the condition stated above provided that they are of a sufficient number to ensure a uniform torque during at least the first twenty fours hours of operation.

Figure 2:
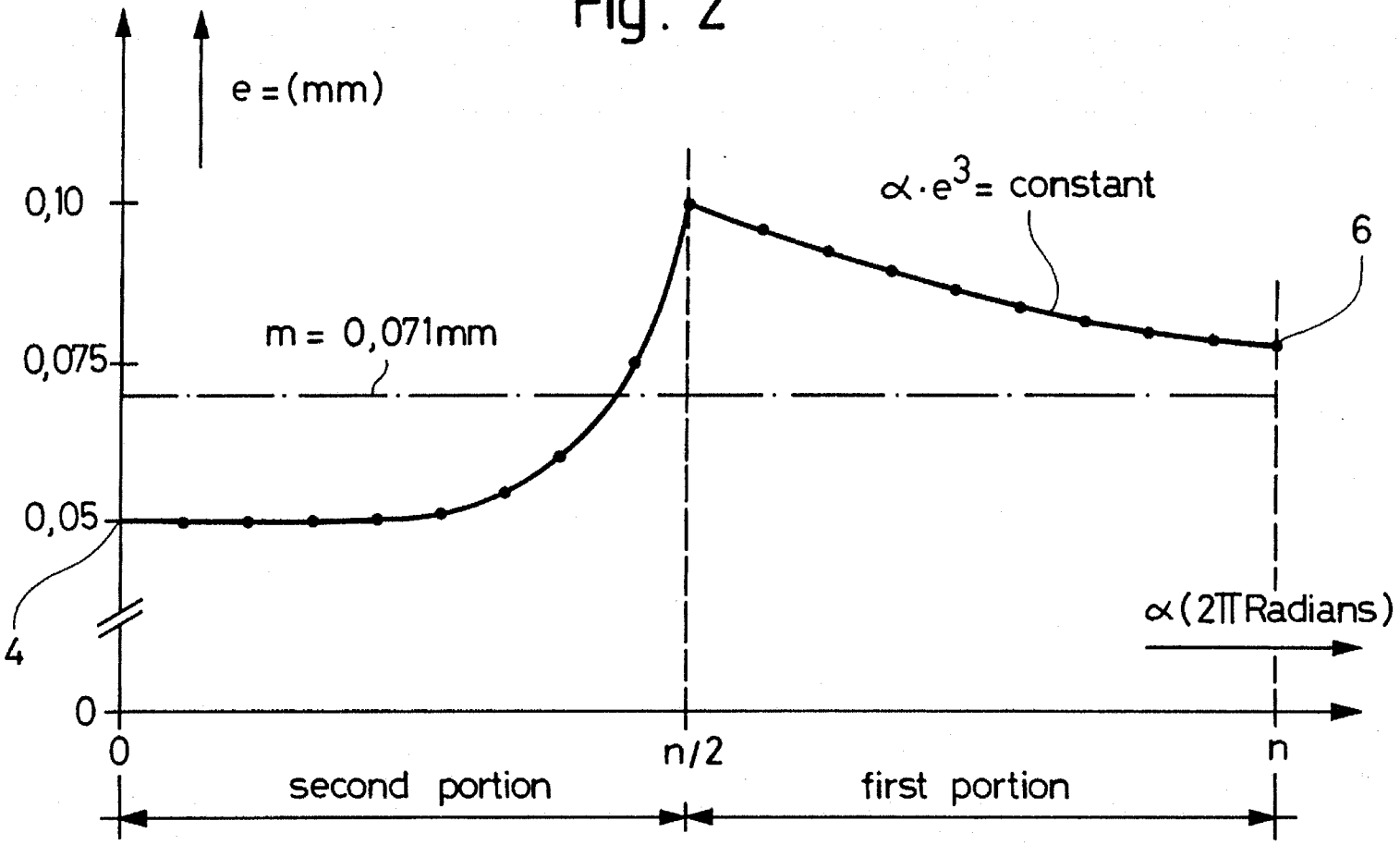

FIG. 2 is a diagram showing spring thickness e as a function of coiling angle $\alpha$·of the spring. The spring comprises n coils spread out on $n2\pi$ radians. According to this diagram, which is one example among many others which could have been chosen, second end 6 of spring 2, or the external end, has a thickness of e=0.077 mm, so that $e^3$=0.000454. At this place $\alpha$=n equals 9, so that $\alpha \cdot e^3$= 9·0.000454=0.00410. Similarly, if $\alpha$=n/2 equals 4.5 at the limit of the effective part of the spring, thickness e of the spring will be given a value e =0.097 mm, namely $e^3$=0.000911, which gives $\alpha \cdot e^3$=4.5·0.000911=0.00410, which respects the condition $\alpha \cdot e^3$=constant.

In FIG. 2 it can be seen that after the effective part or first portion of the spring, a second portion is coiled situated between the end of the first portion and core 5. The thickness e of the spring decreases from angle $\alpha$=n/2 to angle $\alpha$=0. This second portion, required for the operation of the barrel, no longer needs to satisfy the stated condition, since precision is less important after twenty four hours of operation. As it is necessary to have a sufficient number of coils to house in the barrel, the required increase in thickness in the first portion will be compensated by a reduction of thickness in the second portion according, for example, to an arithmetical average extending over the totality of the coils, which will result in being able to place in the barrel as many coils as if it were an ordinary coiled-spring. Thus in the example given in FIG. 2, the thickness of the spring decreases very rapidly at the end of the first portion ($\alpha=n\pi$ radians) where e≅0.1 mm to reach a value of e=0.05 mm at the last coils encircling core 5. In the case shown an average spring thickness value m of the order of 0.071 mm is obtained.

What is claimed is:

1. A mainspring (3) for a timepiece, coiled inside a barrel at an angle $\alpha$ of $n2\pi$ radians, said spring having a rectangular section spiral form of constant width (h), and comprising n coils; a first end (4) of the spring being hooked to a core (5) integral with an arbor of the barrel, and a second, opposite end (6) being fixed to a wall (2) of the barrel;

said spring comprising:

a first portion, extending in a direction from the barrel wall (2) towards the core, in which the thickness e of the spring increases in the direction; and a second portion extending between an end of said first portion and the core, said first portion exhibiting a length sufficient to provide operating power to the timepiece during at least the first twenty four hours of operation;

wherein the thickness e of the spring is selected so that the coiling angle $\alpha$ of said first portion of the spring times the cubed value of the thickness e of said spring at said angle $\alpha$ has a constant value, namely $\alpha \cdot e^3$=constant.

2. The mainspring according to claim 1, wherein, in said second portion of the spring, the thickness of said spring decreases in a direction from the end of said first portion to the core.

3. The mainspring according to claim 1, wherein the spring extends substantially at an angle of $n2\pi$ radians, and wherein the first portion extends at an angle of $n\pi$ radians.

* * * * *